US006554049B2

(12) United States Patent
Steele et al.

(10) Patent No.: US 6,554,049 B2
(45) Date of Patent: Apr. 29, 2003

(54) PROCESS FOR RECOVERING SAND AND BENTONITE CLAY USED IN A FOUNDRY

(75) Inventors: Robert C. Steele, Atlantic Beach, FL (US); Allen James Huff, Three Rivers, MI (US)

(73) Assignee: Foundry Advanced Clay Technologies, L.L.C., Atlantic Beach, FL (US)

( * ) Notice: Subject to any disclaimer, the term of this patent is extended or adjusted under 35 U.S.C. 154(b) by 36 days.

(21) Appl. No.: 09/858,060

(22) Filed: May 15, 2001

(65) Prior Publication Data

US 2003/0029592 A1 Feb. 13, 2003

(51) Int. Cl.[7] ..... B22C 5/00
(52) U.S. Cl. ..... 164/5; 164/131
(58) Field of Search ..... 164/5, 16, 131, 164/412, 344, 404

(56) References Cited

U.S. PATENT DOCUMENTS

| | | | | |
|---|---|---|---|---|
| 4,149,581 A | * | 4/1979 | Adkinson et al. | 164/5 |
| 4,303,453 A | * | 12/1981 | Jung et al. | 134/10 |
| 4,981,581 A | * | 1/1991 | Didion | 209/28 |
| 5,992,499 A | | 11/1999 | Tordoff et al. | 164/5 |
| 6,015,846 A | | 1/2000 | Toussaint et al. | 523/142 |

* cited by examiner

*Primary Examiner*—Tom Dunn
*Assistant Examiner*—I.-H. Lin
(74) *Attorney, Agent, or Firm*—Calfee, Halter & Griswold, LLP

(57) ABSTRACT

Sand, bentonite clay and organics recovered as foundry waste from a green sand mold foundry are reclaimed for reuse in making new green sand molds and mold cores by a multi-step process involving both hydraulic and mechanical separation steps.

7 Claims, 3 Drawing Sheets

Green Sand Foundry Process Flow

PROCESS FOR RECOVERING SAND AND BENTONITE CLAY USED IN A FOUNDRY

FIELD OF THE INVENTION

The present invention relates generally to the field of sand cast molding. More specifically, the invention relates to a process and apparatus for recovering molding media in a foundry, and the process for using the recovered molding media in the foundry.

BACKGROUND OF THE INVENTION

Green sand casting is a well-known process for forming cast metal articles. In this process, a casting mold for making castings, formed from molding media that is primarily sand and bentonite clay, is used in only one molding cycle for the production of one or multiple castings. Once the casting solidifies in the mold, the mold is broken down and the casting cycle is complete. A portion of the molding media can be recycled for another casting process, however, much of the molding media exits the foundry as foundry waste. In the U.S. alone, foundry waste accumulates at a rate of approximately 6 to 10 million cubic yards per year. The large volume of foundry waste coupled with the increasing cost of landfill acreage and transportation is problematic.

In Green Sand Foundries a casting mold is made using a "green sand mold" that defines the external body of the casting and a "core" that is placed inside the green sand mold to define the internal configuration of the casting. FIG. 1 is a process flow diagram illustrating the well-known manner in which molding media is used to form green sand molds and cores used in a casting cycle within a green sand foundry. Prime (i.e. new) silica sand of input stream 1 and the chemical binder of input stream 3 are used to produce cores in core-forming step A. The core, which must withstand high pressure during formation of the casting, is made by coating the particles of sand with any one of a number of chemical binders, such as for example a two-part urethane system, and which are well known in the art. The sand/chemical binder mixture is pre-formed according to the internal configuration of the casting to be made and the chemical binder is then reacted to complete a high-tensile core. Prime silica sand 2, bentonite clay 4 and organic additives 5 are used to produce green sand molds at mold-forming step B. The green sand mold is made by press forming sand that is coated by a mixture of bentonite and organic additives, generally known as "bond." The addition of water of input stream 6 hydrates the bond and causes the grains of sand to adhere to one another and take shape. The green sand molds typically comprise by weight, from about 86% to 90% sand, 8% to 10% bentonite clay, 2% to 4% organic additives and 2% to 4% moisture.

After the core and green sand mold are formed the core is inserted into the green sand mold and molten metal is poured into the green sand mold to produce a casting at casting step C. After the molten metal solidifies, the casting undergoes "shakeout" at shakeout step D to break apart the green sand mold and the core into small particles or clumps. During shake out the particles of the core flow out of the solidified casting and become commingled with the particles from the green sand mold. A portion of the materials that once made up the green sand molds and core, represented by output stream 7, are recycled to make green sand molds at mold-forming step B for a subsequent casting cycle, and an excess portion of the materials that once made up the green sand molds and core, represented by output stream 8, exits the process as "molding waste." The addition of prime sand 2 at mold-forming step B compensates for the "fine" sand that is taken out of the process after each casting cycle. Prime bentonite clay 4 and prime organic additives 5 compensate for the additional bond needed to coat the uncoated prime sand and also the uncoated sand that once made up the cores. The addition of prime bentonite clay and organic additives also compensates for molding media loss due to high temperature exposure.

The excess molding media, that is, foundry waste which cannot be reused for subsequent casting cycles, is generated at several locations within the foundry. The composition and particle size distribution of foundry waste can vary depending upon the areas of the foundry in which it is collected, but foundry waste can be generally classified in two broad categories, namely, "molding waste" and "bag house dust". The term "molding waste" refers to the excess molding media from broken down green sand molds and cores, output stream 8, produced during shakeout. Another source of foundry waste, represented by stream 9, is generated by defective cores that never get used in the casting operation. Molding waste can include materials present in both output streams 8 and 9, as well as molding media which fall from the conveyor system at various stages throughout the foundry. In many green sand foundries, the molding waste typically contains by weight from about 80% to about 90% sand, from about 6% to about 10% bentonite clay and from about 1% to about 4% organic additives. Molding waste includes sand that is coated with bond as well as individual particles of sand, bentonite and organic additives.

Attempts have been made to reduce the accumulation of molding waste by mechanically removing the bond from the sand so that the sand is sufficiently clean to be reused in the production of cores. In such processes the sand is recovered, but the bentonite clay, which costs several times more than sand on a weight basis, and the organic additives are discarded. Another disadvantage of mechanical reclamation is that the cost of prime sand is sufficiently low in many geographic areas that the capital investment for sand recovery is economically unfeasible.

Another large source of foundry waste, stream 10, includes fine particles of sand, bentonite clay, organic additives and debris collected in the foundry's air evacuation system. Foundry waste 10 is commonly known in foundries as "bag house dust". Bag house dust contains substantially more bentonite clay than does molding waste. Bag house dust typically comprises from about 40% to about 70% sand, from about 20% to about 50% bentonite clay and from about 10% to about 30% organic additives.

In some cases, certain foundries have been able to recover bentonite clay by introducing the bag house dust back into the water system that is used for making green sand molds in the casting process. In this manner, the bag house dust is mixed into the water system treated according to the advanced oxidation process (AO technology) and is placed into a settling tank. See, *Advanced Oxidants Offer Opportunities to Improve Mold Properties, Emissions;* Modern Casting, September, 2000, p. 40–43. Upon settling, water containing bentonite clay is pulled from the top of the settling tank and reused in the green sand molding lines. A disadvantage, however, is that the sludge which settles out of the settling tank and is discarded contains most of the sand in the bag house dust.

Accordingly, there is a need to reduce the amount of foundry waste exiting a green sand foundry. There is also a need for a process to recover sand that has sufficient quality to be used in the foundry to make cores and green sand molds and which can yield quality castings in a subsequent casting process. There is also a need for a process to recover sand, bentonite clay and organic additives to decrease the amount of prime materials that enter the foundry as raw material.

SUMMARY OF THE INVENTION

These and other needs are addressed by the present invention which is based on the recognition that much of the sand and bentonite clay contained in foundry waste derived from a typical green sand foundry can be recovered for reuse in making new green molds by a two-step hydraulic separation procedure which first recovers coarse sand suitable for reuse in making new green sand molds from the waste and thereafter separates out fine sand unsuitable for use in making new green molds from the remainder of the waste to produce an aqueous byproduct bentonite clay stream that can also be used in making new green molds.

Thus in one embodiment of the invention, bag house dust, after slurrying in water, is hydraulically separated to produce an underflow output stream containing at least about 40% of the sand originally contained in the bag house dust as well as an aqueous overflow stream containing at least about 60% of the bentonite clay in the bag house dust. In accordance with the present invention, it has been found that the relatively coarse sand contained in the underflow has a particle size distribution allowing it to be directly used for making new green sand molds for a subsequent casting cycle. Accordingly, this coarse sand product is recycled to the green mold preparation station, after optional removal of water, for reuse in making additional green sand molds. The aqueous overflow stream produced as a byproduct of the first hydraulic separation step, if desired, can be subjected to a second hydraulic separation step to remove most of its sand content. This sand is too fine to be useful in making additional green sand molds and is therefore discarded. However, the effluent output stream produced as a result of this second separation step, which contains at least about 50% of the bentonite clay originally found in the bag house dust but very little sand, can also be directly used for making new green sand molds and accordingly is also recycled to the green sand molding station for this purpose.

In another embodiment of the invention, the molding waste produced during operation of a typical green sand foundry is processed in essentially the same way as described above. However, in this instance the molding waste is first mechanically separated to produce a lighter and a heavier fraction. The lighter fraction contains most of the bentonite clay and organic components in the mold waste and therefore can be processed in the same way as described above, by itself or together with the bag house dust produced by the foundry, to recover its useful sand and bentonite clay values for making still additional green sand molds. The heavier fraction produced by mechanical separation is composed predominantly of sand. In accordance with still another feature of the invention, this reclaimed sand product can be made to exhibit a particle size and particle size distribution approximating that of prime sand by carrying out the mechanical separation process in an appropriate manner. Therefore, this heavier sand fraction, when appropriately made in accordance with the present invention, can replace at least some of the prime sand used in making new mold cores, thereby significantly reducing the foundry's total demand for prime sand in its overall green sand molding process.

DESCRIPTION OF THE DRAWINGS

The present invention may be more readily understood by reference to the following drawings wherein:

FIG. 3(*b*) is a photomicrograph of a reclaimed sand product produced according to the invention herein.

DETAILED DESCRIPTION OF THE INVENTION

In accordance with one embodiment of the invention, sand, bentonite clay and organic additives are recovered from the bag house dust produced by a typical green sand foundry and reused to make additional green sand molds. Silica sand is commonly used and green sand can also include, for example, silica sand, lake sand (silica and calcium, shell, etc.), chromite sand, zircon sand, olivine sand, nickel slag, and carbon sand. Also, different types of bentonite clay are used and can include calcium bentonite, sodium bentonite and sodium-activated bentonite, for example. Organic additives used in green sand foundries, include but are not limited to, cellulose, cereals, starch, causticized lignites, sea coal, gilsonite, and anthracite, for example.

Figure 2:
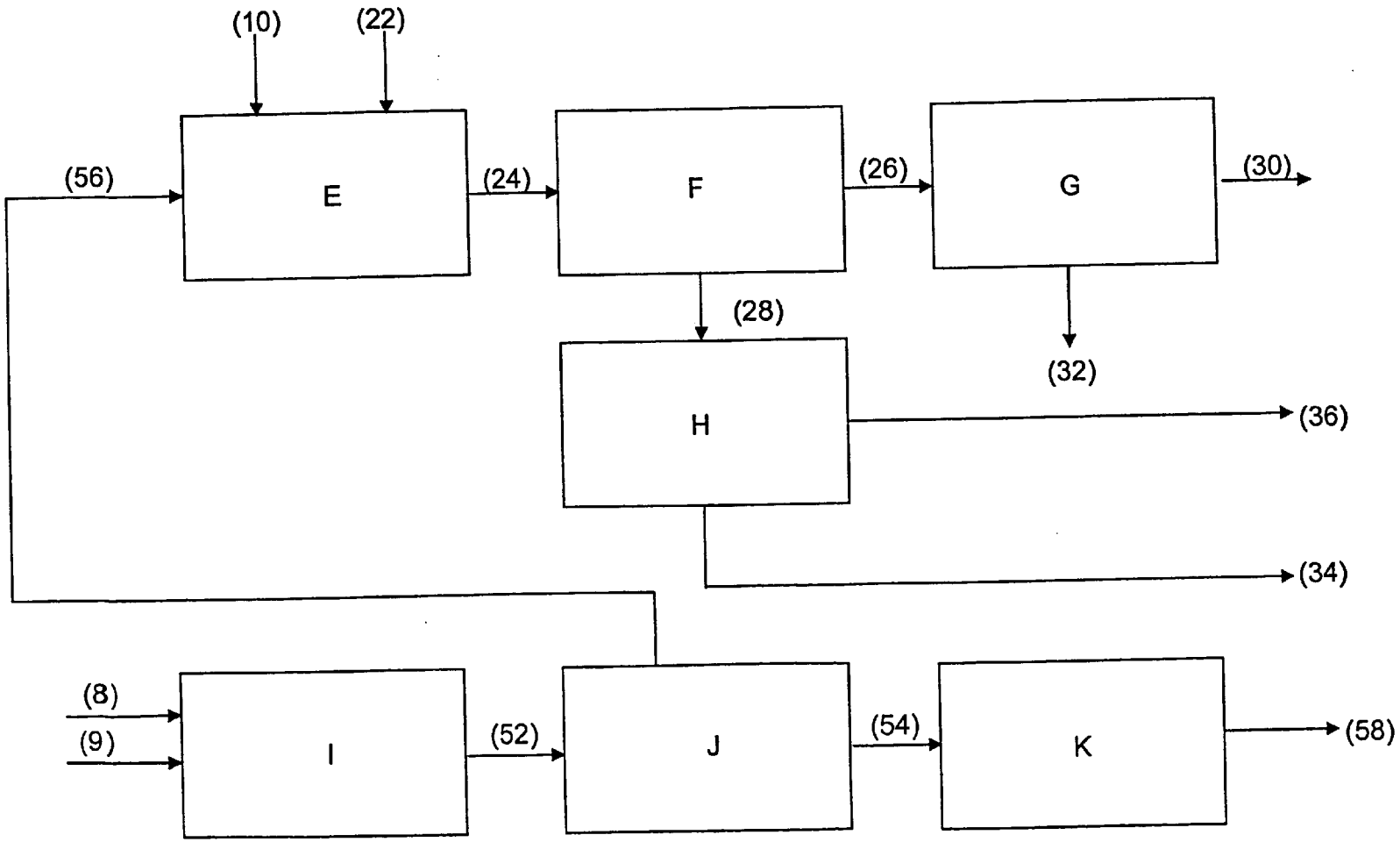
FIG. 2 is a schematic process flow diagram illustrating the present invention.

This process to recover sand, bentonite clay and organic additives in a green sand foundry is illustrated in FIG. 2, which shows bag house dust 10 and water 22 being fed into a slurry tank and mixed at slurry step E to produce slurry 24. Although any amount of water can be added in slurry step E, normally the amount of water added will be at least about 10 times the amount of bag house dust on a weight basis. More typically, the amount of water added will be enough so that the weight ratio of water to bag house dust is between about 12:1 and 40:1, more preferably between about 15:1 and 30:1.

Slurry 24 is then transferred to separation step F where it is hydraulically separated to recover the coarser, heavier sand particles therein for reuse in making additional green molds. By "hydraulically separated" is meant that the slurry is subjected to a force such as gravity or centrifugal force so that the heavier, coarser particles separate out from the other components of the slurry—i.e., the water and lighter, finer particles.

Various methods and equipment can be utilized to hydraulically separate particles of different sizes and densities from one another. For example, fluid handling equipment which imparts centrifugal force on the slurry to move the larger or denser particles apart from the smaller, lighter particles can be used. Examples of such fluid handling equipment include hydroclones and centrifuges. A hydroclone has a stationary, vertical cylinder with a conical bottom that imparts centrifugal force on slurry which enters at an inlet near the top. The incoming slurry receives a rotating motion on entrance to the cylinder, and the vortex so formed develops centrifugal force which forces the heavier sand particles radially toward the wall of the hydroclone and separates them from the fluid containing the fine particles. The centrifugal force imparted on the slurry increases the settling rate of the coarser sand and causes the sand to settle to the bottom well ahead of the finer particles. An underflow stream containing the coarser sand particles exits out the bottom of the hydroclone, while an overflow stream containing the particles not having separated out exits through an outlet located above the outlet for the underflow. A commercially-available example of such a unit is Hydroclone Unit 212 available from Swaco Inc. of Houston, Tex.

Separation step F is carried out in accordance with the present invention so that at least about 40% of the sand in slurry 24 is recovered in underflow output stream 28, while at least about 60% of the bentonite clay in slurry 24 is recovered in overflow stream 26. In accordance with the present invention it has been found that, when operating in this manner, at least about 80% of the coarse sand product recovered in underflow output stream 28 will normally have a particle size of at least about 60 microns. This particle size is appropriate for making new sand molds, and so underflow output stream 28 can be recycled directly to mold-forming step B for reuse of the sand therein in making additional green sand molds by the foundry, if desired.

In the particular embodiment shown, underflow output stream 28 is de-watered at de-watering step H to remove most of the water from the recovered coarse sand therein. Solids fraction output stream 34, which contains substantially all of the sand in underflow output stream 28 and no more than about 10 wt. % water, more typically no more than about 2 wt. % water, can be recycled directly or indirectly to mold-forming step B for manufacture of additional green molds. Alternatively, the sand of output stream 34 can be dried and used as an additive for core-forming step A or another application inside or outside the foundry.

Separation step H also produces liquid fraction 36, which normally contains about 1 to 3 wt. % of the bentonite clay and about 8 to 15 wt. % of the organic additives in slurry stream 24. This stream can also be directly recycled back to mold-forming step B.

Many different types of commercially available equipment can be used for carrying out separation step H. Examples are desilter units, mud cleaners, and shaker decks. A particular example of one such commercially available pieces of equipment is Desiltering Unit Model No. 202 available as from the Swaco Corporation of Houston, Tex.

As indicated above, separation step F is carried out so that at least about 40% of the sand in slurry 24 is recovered in underflow output stream 28, while at least about 60% of the bentonite clay in slurry 24 is recovered in overflow stream 26. When operating in this manner, about 60% or more of the organics originally contained in slurry 24 will also be recovered in overflow stream 26. Preferably, separation step F is operated so that about 50 to 80% of the sand in slurry 24 is recovered in an underflow output stream 28, while about 70 to 95% of the bentonite clay and 70 to 90% of the organics originally contained in this slurry are recovered in overflow stream 26. In some instances, separation step F is operated so that about 60 to 80% of the sand in slurry 24 is recovered in an underflow output stream 28, while about 80 to 95% of the bentonite clay and 75 to 85% of the organics originally contained in this slurry are recovered in overflow stream 26.

As well appreciated by those skilled in the art, the degree of separation achieved when operating commercially available hydraulic separation equipment depends on the various operating variables of the equipment used, including the degree of centrifugal or other force exerted on the slurry, the flow rate at which the slurry is introduced into the equipment, residence time and so forth. The effects of these processing variables can easily be determined through routine experimentation to achieve the degree of separation desired, as indicated above.

Depending on the composition of bag house dust 10 as well as the way first hydraulic separation step F is operated, aqueous overflow stream 26, which is also produced in separation step F, may contain a significant amount of sand having a particle size of about 20 microns or less. Since this particle size is too fine to be of interest in making additional green sand molds, overflow stream 26 is processed to remove this sand content as well as other debris that may be present in this stream. This is shown in FIG. 2 as second hydraulic separation step G.

In accordance with the present invention, second separation step G is accomplished to remove substantially all of the sand in aqueous overflow stream 26 and thereby produce effluent output stream 30 comprising a maximum of about 5%, preferably about 3%, and even more preferably, about 1% of the sand originally contained in the overflow stream 26. Effluent output steam 30 also contains much of the bentonite clay and organic additives originally in overflow stream 26, and it has been found in accordance with the present invention that a significant amount of this retained bentonite clay is "active" in the sense that it will exhibit some active binding properties when dehydrated then rehydrated. Accordingly, this recovered bentonite clay can be used as a source of active bentonite for making additional green molds by recycling effluent output stream 30 directly or indirectly to mold-forming step B, rather than discharging this stream to waste.

As in step F, separation step G may be accomplished using well-known hydraulic, gravitational or centrifugal separation units, such as a hydroclone or a centrifuge, for example, for imparting a gravitational and/or centrifugal force on aqueous overflow stream 26 to increase the differential settling rates of the heavier, larger particles from the lighter, finer particles to physically move the particles apart so they can be withdrawn separately. It has been found that substantially all of the fine sand particles can be removed from the effluent which maintains most of the bentonite clay.

As previously indicated, the sand particles in overflow stream 26 are too fine to be of interest for making additional green sand molds. For example, 80% or more of the sand in solids discharge stream 32 normally has a particle size of about 20 microns or less. Accordingly, solids discharge stream 32 is normally discharged to waste. Surprisingly, it has also been found that these sand particles, together with the organic materials and other debris that might be present, coalesce in the form of colloidal agglomerates, probably because of the residual bentonite clay present. It is believed that the encapsulation of sand and organic materials by the bentonite, reduces environmental hazards associated with disposing of this material.

In summary, the inventive process as described above recovers about 40% or more of the sand, about 60 wt. % or more of the bentonite clay and about 20 wt. % or more of the organic additives originally contained in the foundry's bag house dust. Previous known methods do not recover these materials at all, or if they do recover these materials, they only recover some of them under limited conditions incidental to the operation of advanced oxidation technology. AO technology is not necessary in accordance with the present invention, although it can also be used, if desired. In any event, the recovered materials produced in accordance with the present invention can be recycled in the foundry to make additional green sand molds, thereby substantially reducing the amount of prime (make-up) sand, bentonite clay and organics that must be added to keep the foundry running and also substantially reducing the amount of waste produced.

In another embodiment of the present invention, the above separation technique is used to recover sand, bentonite clay and organics from the molding waste also produced by green sand foundries. This aspect of the present invention is also illustrated in FIG. 2.

Molding waste 8 derived from shake out step D and/or molding waste 9 derived from core-forming step A (and/or molding waste formed from unused or defective green sand molds from mold-forming step B) initially undergoes drying, screening and demagnetizing at preparation step I to produce dry molding waste product 52. The molding waste may also be subjected to a preliminary crushing step, before or after drying, if necessary.

Dry molding waste product 52 should have a moisture content of 10 wt. % or less, preferably 4 wt. % or less, 2 wt. % or less, or even 0.5 wt. %. In addition, it should have a particle size such that no more than 20 wt. % has a particle size exceeding 8 mesh and preferably 10 mesh. Molding waste product 52 is also desirably free substantially of iron and other metallic components capable of magnetic separation, as such materials constitute contaminating waste. Equipment for drying, screening and demagnetizing foundry waste as accomplished in preparation step I is commercially available. Also, molding waste 8/9 need not be dried, screened and demagnetized as described above, if desired, as the techniques and advantages of the invention will be realized whether or not such pretreatment is done. However, the processing steps described below will work more efficiently to produce better quality reclaimed materials if the molding waste is dried, screened and demagnetized in this manner.

According to the second embodiment of the present invention, molding waste product 52 is subjected to mechanical separation in separation step J. By "mechanical separation" it is meant a separation process in which the molding waste is subjected to significant mechanical impact or abrasion to physically break apart agglomerates containing multiple sand particles and/or to separate from these sand particles, at least partially, the bentonite clay, carbonaceous additives and other chemical binders that may be present on the surfaces of these particles.

Numerous different types of commercially available equipment can be used for carrying out mechanical separation step J of the present invention. In some, the material to be processed is propelled against a solid object, such as by the action of a jet of air or other gas. In others, the material is ground upon itself. A mechanical separation unit that causes molding waste to be blown via a gas and impinged onto a stationary plate is the EvenFlo Pneumatic Reclaimer unit available from Simpson Technologies of Aurora, Ill. A mechanical separation unit that abrades particles of molding waste against one another is Model NRR32S unit available from Sand Mold Systems, Inc. of Newaygo, Mich. As well appreciated by those skilled in the art, the extent of separation achieved by these machines depends upon a variety of operating factions including retention time, velocity of the particles, number of iterations in which the particles of waste are processed, and so forth.

Mechanical separation process step J yields a lighter fraction (residual stream 56 in FIG. 2) composed of sand, bentonite clay and organic additives and a heavier fraction (output stream 58 in FIG. 2) composed primarily of coarse sand. In prior art methods of recovering sand from molding waste, the residual sand, bentonite clay and organic additives are discarded. In accordance with the present invention, however, it has been found, however, that residual output stream 56 can be processed in the same way as discussed above in connection with bag house dust 10 to also recover the sand, bentonite clay and organic additives in this residual stream for making still additional green sand molds.

In accordance with this aspect of the present invention, therefore, residual output stream 56 is transferred to slurry step E where it is made into a slurry and then subjected to first hydraulic separation step F and second hydraulic separation step G to produce aqueous overflow stream 26, underflow output stream 28, effluent output stream 30, solids discharge stream 32, solids fraction output stream 34, and liquid fraction 36, in the same way as described above. As in the case of processing bag house dust, it has been found in accordance with this aspect of the present invention that it is also possible to recover about 40% or more of the sand, about 60 wt. % or more of the bentonite clay and about 20 wt. % or more of the organic additives originally contained in residual output stream 56 by carrying out the first and second hydraulic separation steps in the manner described.

In an especially preferred embodiment of the invention, as illustrated in FIG. 2, both residual output stream 56 as well as bag house dust 10 are formed into slurry 24 for further processing. By this approach, both sources of foundry waste—bag house dust and molding waste—can be processed simultaneously to recover the sand, bentonite clay and organics therein for making additional green sand molds. Accordingly, the amount of make-up sand, clay and organics need to operate the foundry, and the overall waste produced by the foundry, can be reduced even more.

In addition to residual output stream 56, mechanical separation process step J also yields output stream 54 composed primarily of coarser sand. Normally, this coarser sand product will be composed of about 30% to 90%, preferably about 50% to 85%, and even more preferably about 75% to 85% of the sand in molding waste 8/9. In accordance with the present invention, it has been further found that this coarse sand product can be made to approach prime silica sand in terms of composition and particle size distribution by carrying out mechanical separation process step J in an appropriate manner. Therefore, in accordance with a particularly preferred embodiment of the invention, the coarse sand product in output stream 54, after washing and drying at finishing step K, is recovered for reuse in making additional new mold cores by recycling this product directly or indirectly to core-forming step A.

Two factors help determine if the reclaimed sand product in output stream 54 can be used as a replacement for prime (new) silica sand in making new mold cores. The first is the amount of residual bentonite clay and organic additives remaining on the surface of sand particles of this product and the second is the particle size of this product.

The bentonite clay and organic additives remaining on the surface of sand particles recovered from separation step J may interfere with the new chemical binder added to these recovered sand particles in the manufacture of new cores. This, in turn, may detrimentally affect the strength of the new cores and ultimately the quality of the castings made from these cores. Accordingly, separation step J should be accomplished to remove enough of the clay and organics originally on the sand in output stream 54 so that the bond strength of new cores made with this reclaimed sand will not be adversely affected to any significant degree.

One way to determine if enough of the clay and organics have been removed in mechanical separation step J is to determine the "AFS clay measurement" of the recovered sand according to AFS Procedure No. 110-87-S. As well known to those skilled in the art, this test method is a standard of the American Foundry Society which measures the amount of fine particulate matter, including material other than clay, on the surfaces of sand grains. The AFS clay of prime sand entering green sand foundries typically has an AFS clay of about 0.3. In accordance with the present invention, the reclaimed sand recovered from separation step F desirably has an AFS clay value that is less than about 0.5, preferably, less than about 0.4, and even more preferably, less than about 0.3.

Another method for determining if enough clay and organics have been removed in separation step J is to test the bond strength of a test core made from the reclaimed sand. In other words, a test core containing all of the ingredients intended to be used to make product cores, including the reclaimed sand to be tested, can be tested to determine its tensile strength by AFS Procedure N. 317-87-S, for example. If the tensile strength of the test core exceeds the minimum acceptable tensile strength suitable for withstanding the pressure to be encountered in the planned casting process, then it follows that sufficient clay and organics were removed in separation step J.

In an alternative to this approach, the test core can be made using reclaimed sand only. In other words, no prime sand is used to make the test core, only reclaimed sand. Achieving an acceptable tensile strength in this instance indicates that the reclaimed sand recovered from separation step J will not reduce bond strengths below an acceptable level, even if no prime sand is used to make product cores. This, in turn, suggests that product cores made with significant amounts of prime sand, in addition to reclaimed sand of the present invention, should be even stronger than minimum acceptable levels.

It is also desirable that the reclaimed sand in output stream 58 have a particle size distribution that is similar to the particle size distribution of the prime sand that it will be used to replace. Sand particles can break down if too much contact force is used in separation step J, which in turn can lead to a reclaimed sand product containing too many fine sand particles to be useful. Therefore, care should be taken during separation step J to avoid contacting conditions so severe that the reclaimed sand product in output stream 58 contains more than about 3 wt. % fines defined as the sum of the weight retained on the 200 and 270 screens and pans.

As will be understood by those skilled in the art, neither of the above factors (particle size and surface residuals) is an absolute requirement for allowing the reclaimed sand recovered in output stream 58 to be used as a replacement for prime sand in core forming step A, at least to some degree. Rather, these factors are guides which will help determine how mechanical separation step J should be accomplished in particular instances.

In other words, even if the particle size and surface residuals of the reclaimed sand do not meet the above standards, it still may be possible to use this reclaimed sand as a substitute for at least some of the prime sand in making new mold cores. On the other hand, the more the reclaimed sand resembles prime sand in terms of both surface residuals and particle size, the more likely it is that greater amounts of this product can be used as a prime sand replacement without adverse impact on the mold cores produced. Therefore, in carrying out specific instances of the inventive process, surface residuals and particle size can be used as handy guideposts to help determine exactly how mechanical separation should be carried out.

In order to more fully and clearly describe the present invention so that those skilled in the art may better understand how to practice the present invention, the following examples are given. The following examples are intended to illustrate the invention and should not be construed as limiting the invention disclosed and claimed herein in any manner.

EXAMPLE 1

Figure 1:
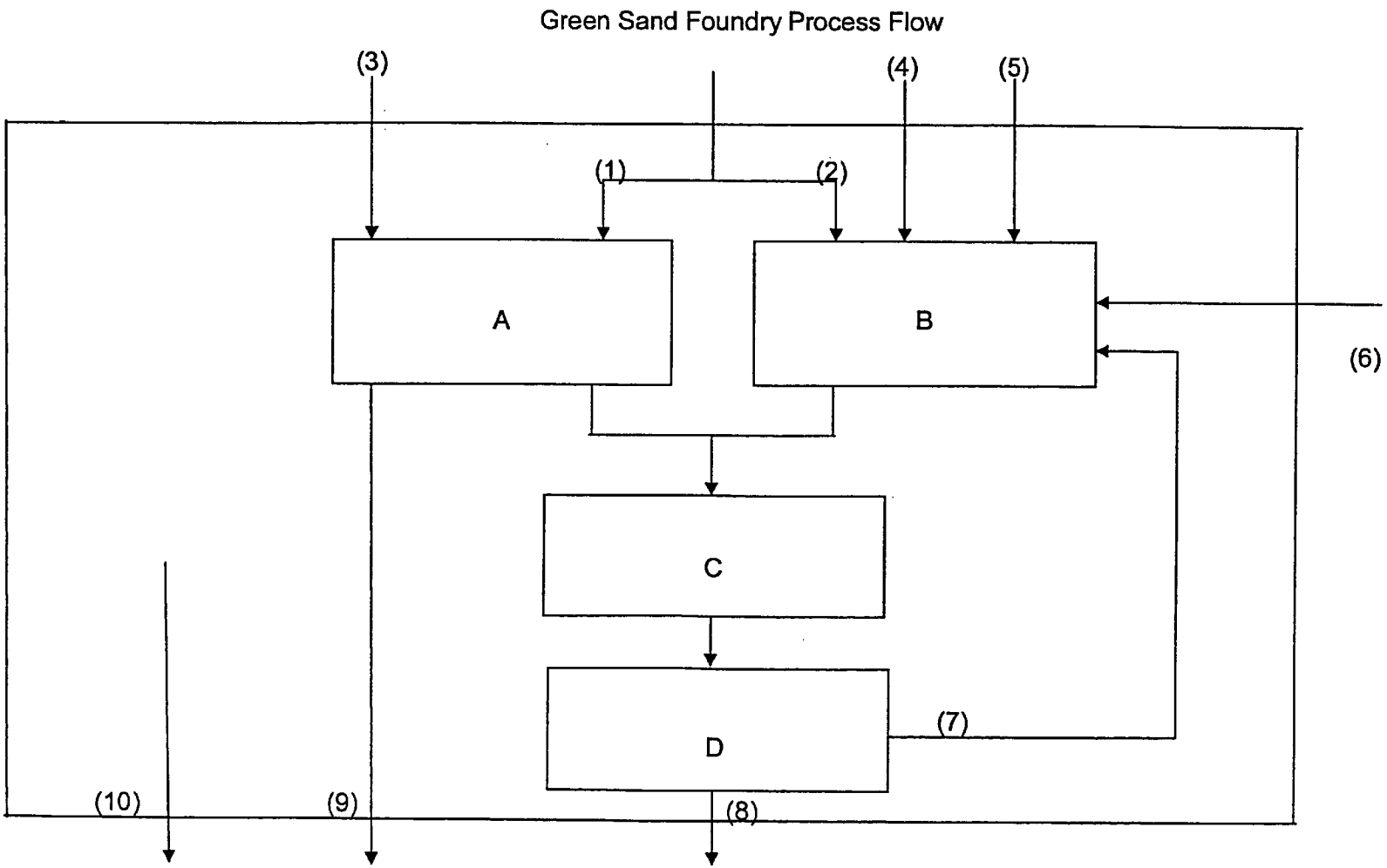
FIGURE 1 PRIOR ART
FIG. 1 is a schematic process flow diagram illustrating how the molding media used to form green sand molds and associated mold cores are received, used and discharged in a typical green sand foundry.

1600 pounds of bag house dust obtained from a green sand foundry producing approximately 350 molds per hour was processed using the hydraulic separation scheme illustrated in FIG. 1. The bag house dust, which contained 864 pounds of sand, 448 pounds of bentonite clay and 288 pounds of organic additives, was mixed with 20,164 pounds of water to make a slurry (Slurry 24). The slurry was then fed into a hydroclone, model unit 212 from Swaco, to separate the sand from the bentonite and organic additives in a first hydraulic separation step (Step F). An overflow stream (26) and an underflow stream (28) were produced. The underflow stream contained 518 pounds of sand (60% of the sand present in the bag house dust), 13 pounds of bentonite clay (3%), 53 pounds of organic additives (18%), and 4757 pounds of water. 80% of the sand product in the underflow stream had a particle size larger than 60 microns, indicating that this sand product could be reused to make additional green sand molds.

The overflow stream contained 435 pounds of bentonite clay (97% of bentonite clay present in the bag house dust), 235 pounds of organic fillers (82%), 346 pounds of sand (40%) and 15,403 pounds of water. This overflow stream was then put through a centrifuge to further separate (Step G) the sand fines and debris from the bentonite and organic additives. Separation in the centrifuge produced an effluent stream which contained 348 pounds of bentonite clay (78% present in the bag house dust), 105 pounds of organic fillers (36%) and 15,100 pounds of water. The effluent stream also contained less than 1% sand, indicating it could be reused as make up water in forming new green molds. All of the bentonite in the bentonite stream was found to be active bentonite based on the results of methylene blue clay testing.

The solids discharge, which was in the form of wet, colloidal agglomerates, contained 346 pounds of sand (40%), 130 pounds of organic additives (45%), 87 pounds of bentonite clay (19%) and 303 pounds of water (1% total water). 80% of the sand had a particle size less than 60 microns, indicating that it was too fine to be of interest in making additional green sand molds or mold cores.

EXAMPLE 2

To show the ability of commercially available mechanical separation equipment to convert standard molding waste into a reclaimed silica sand product capable of replacing prime silica sand, the following example was conducted.

Approximately 2000 pounds of molding waste produced by the above green sand foundry and having a moisture content of 1.84% was subjected to a multi-pass mechanical separation process using mechanical reclamation equipment available from Sand Mold Systems, Inc. of Newaygo, Mich. Waste sand was introduced at the top of the two-cell unit and came into contact with a rotary drum. Waste sand spun on the drum and was abraded against sand that was built up on the shelf. The bentonite, organic additives and the binder that was removed from the sand grain was collected through a dust collection system and the heavier sand grains fell to the bottom of the unit and were classified. Six passes were run through the two-cell unit.

The data in Table I below lists several measured characteristics of 1) the molding waste being processed 2) the molding waste after each of the six passes through the two-cell unit, and 3) prime sand (control). Each sample was classified for sand grain size distribution and several physical properties of the sand were measured. In addition, photomicrographs at 40× magnification were also taken of the prime sand raw material used by the foundry in the manufacture of mold cores as well as the reclaimed silica sand produced in as described above after the sixth pass through the two-cell unit.

Figure 3A:
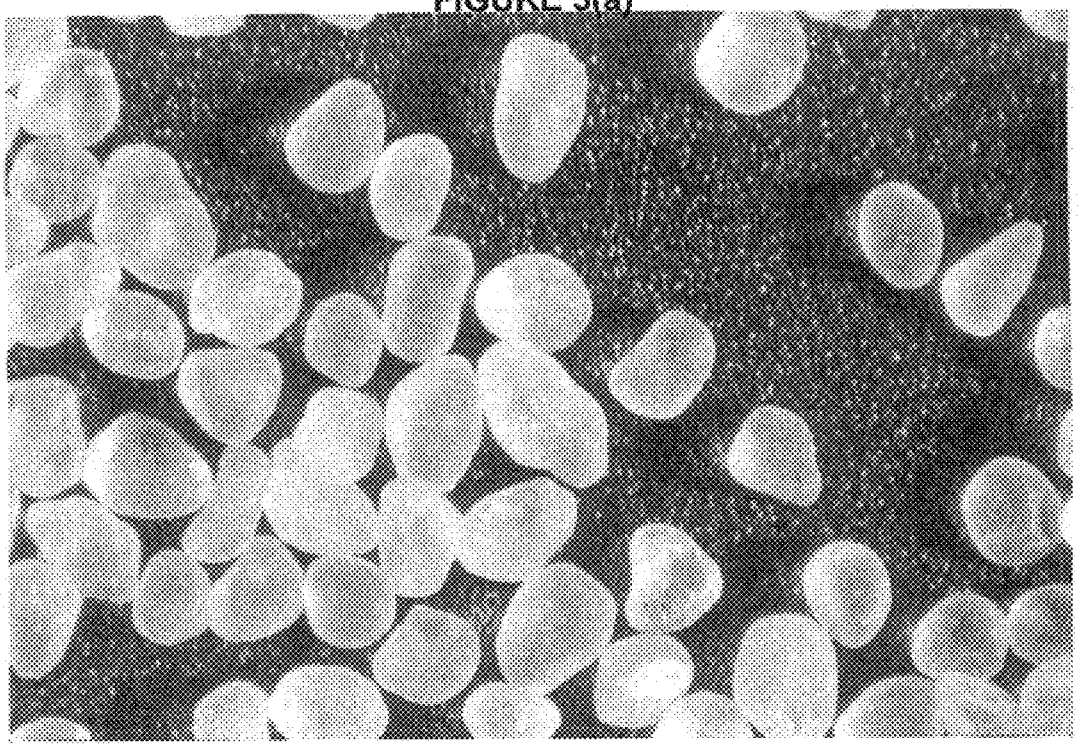
FIG. 3(*a*) is a photomicrograph of typical sample of prime silica sand used to make mold cores in a green sand foundry.
Figure 3B:
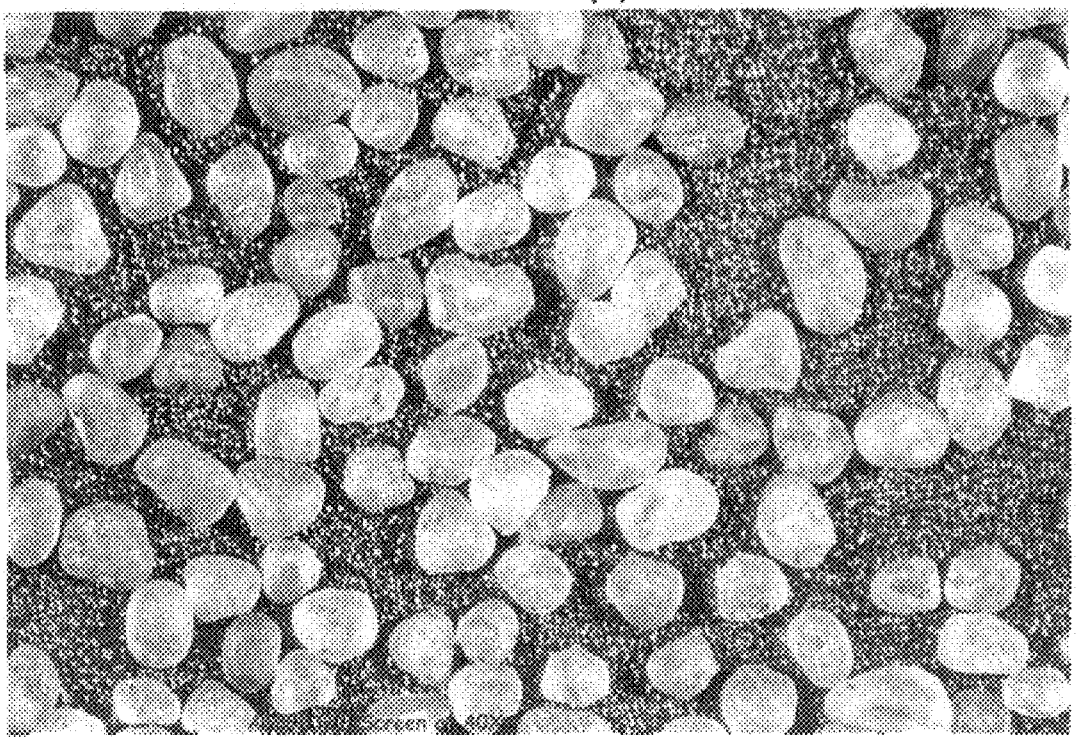

The results of these physical measurements are reported in the following table 1, while the photomicrograph of the prime sand is shown in FIG. 3(*a*) and the photomicrograph of the reclaimed silica sand is shown in FIG. 3(*b*).

TABLE I

| Physical Data | Waste Sand | First Pass | Second Pass | Third Pass | Fourth Pass | Fifth Pass | Sixth Pass | Control (Prime Sand) |
|---|---|---|---|---|---|---|---|---|
| Screen | | | | | | | | |
| 20 Sieve | 2.7 | 0.1 | 0.0 | 0.0 | 0.0 | 0.0 | 0.4 | 0.0 |
| 30 Sieve | 1.3 | 0.2 | 0.2 | 0.3 | 0.2 | 0.2 | 0.3 | 0.4 |
| 40 Sieve | 7.7 | 4.6 | 4.1 | 4.8 | 3.9 | 4.1 | 5.8 | 6.6 |
| 50 Sieve | 14.4 | 11.7 | 10.1 | 11.5 | 11.3 | 10.6 | 13.3 | 13.3 |
| 70 Sieve | 35.4 | 35.0 | 31.3 | 32.8 | 34.2 | 33.1 | 34.2 | 33.7 |
| 100 Sieve | 28.8 | 36.8 | 39.2 | 38.2 | 39.5 | 40.6 | 37.7 | 37.6 |
| 140 Sieve | 7.3 | 10.0 | 12.8 | 11.0 | 10.2 | 10.6 | 8.0 | 7.3 |
| 200 Sieve | 1.6 | 1.4 | 2.1 | 1.4 | 0.7 | 0.7 | 0.4 | 1.0 |
| 270 Sieve | 0.5 | 0.1 | 0.1 | 0.0 | 0.0 | 0.0 | 0.0 | 0.1 |
| Pan | 0.4 | 0.0 | 0.0 | 0.0 | 0.0 | 0.0 | 0.0 | 0.0 |
| AFS GFN | 58.1 | 61.6 | 64.4 | 62.3 | 61.7 | 62.1 | 59.2 | 59.5 |
| Base Perm | 97 | 87 | 98 | 106 | 110 | 115 | 98 | 85 |
| Moisture | 1.84 | 0.52 | 0.21 | 0.14 | 0.15 | 0.09 | 0.07 | 0.01 |
| AFS Clay | 10.64 | 4.68 | 1.99 | 1.30 | 1.02 | 0.74 | 0.46 | 0.15 |
| MB Clay | 11.50 | 5.60 | 2.10 | 1.40 | 1.30 | 0.80 | 0.30 | — |
| LOI | 3.76 | 1.77 | 0.86 | 0.78 | 0.65 | 0.53 | 0.43 | 0.08 |
| pH | 9.89 | 9.95 | 9.75 | 9.62 | 9.49 | 9.40 | 9.02 | 6.97 |

As can be seen from Table 1 and FIGS. 3(*a*) and 3(*b*), the mechanically reclaimed sand resembles the prime sand in size and shape, and the particle size distribution of the mechanically reclaimed sand listed in Table I is nearly identical to the particle size distribution of the prime sand that entered the foundry. This indicates that this reclaimed sand can be readily used as a replacement for at least some of the prime sand used to make new mold cores.

EXAMPLE 3

In order to show the suitability of the reclaimed sand obtained in Example 2 for replacing some or all of the prime sand used to make new mold cores, the tensile strengths several different tensile briquettes were tested. The different tensile briquettes were made using 1) prime silica sand 2) reclaimed sand recovered after the sixth pass through the mechanical separation unit of Example 2, and 3) an 80/20 blend of this reclaimed sand and a prime sand. A phenolic/urethane resin in the amount of 1%, 1.3%, and 1.8% by weight was also included in each briquette as a binder. All tensile briquettes were made according to the following procedure:

Approximately 4,000 grams of (Bridgman 1L-5W washed and dried silica sand (AFS #50) from Bridgman Corporation was placed in a stainless mixing bowl. A small pocket was made in the sand and 28.1 grams of the Part I of the chemical binder resin was poured into the pocket. Part I of the binder resin was a phenolic resin commercially available as Part I from Delta HA Corporation of Detroit, Mich. The binder resin was covered lightly with sand and mixed on a Hobart N-5D mixer at #1 speed for one minute. The bowl was checked for unmixed resin at the sides and bottom of the bowl and them mixed for an additional minute. A small pocket was again made in the mixed sand and 23.4 grams of Part II of the binder resin was poured in the pocket. Part II of the binder resin is an isocyanate compound commercially available as Part II from Delta HA Corporation of Detroit, Mich. The same mixing procedure for the Part II resin was repeated as per the Part I resin to obtain the sand mix. The sand mix was stored in a polyethylene container until it was ready for use in making tensile briquettes.

Tensile briquettes were made by transferring the sand mix from the polyethylene container to a 3-gong capacity metal core box that meets AFS specifications with vents per industry design. A gassing manifold was applied to the core blower, a modified Redford-Carver HBT-1 core blower from Redford-Carver Foundry Products, Sherwood, Oreg., and amine, catalyst, triethylamine (TEA) available from Ashland, Chemical, Cleveland, Ohio, was blown into the core box for seven seconds. The center briquette was removed from the core box and was thereafter placed in a tensile testing machine.

The tensile strength of each core was taken 1 hour after the sand and the chemical binder were mixed and formed into a core. Tensile strengths measurements were taken according to the Thwing-Albert operating manual. Table II lists the results obtained:

TABLE II

| Sand System | Binder Concentration (wt. %) | Tensile Strength (1 hr.) (psi) |
|---|---|---|
| Prime sand | 1 | 210 |
| Reclaimed sand | 1 | 81 |
| 80% RS/20% prime | 1 | 96 |
| Prime sand | 1.3 | 275 |
| Reclaimed sand | 1.3 | 115 |
| 80% RS/20% prime | 1.3 | 141 |
| Prime sand plus 2% glass | 1.3 | 231 |
| Prime sand | 1.8 | 361 |
| Reclaimed sand | 1.8 | 169 |
| 80% RS/20% prime | 1.8 | 223 |
| Prime sand and 2% Macor | 1.8 | 167 |

As can be seen from this table, the tensile strengths of briquettes made with the reclaimed sand of the present invention, although not as high as those briquettes made with prime sand, are still reasonably high. Moreover, the tensile strengths of briquettes made with the reclaimed sand of the present invention can be significantly enhanced by adding small amounts of prime sand thereto. This suggests that product briquettes with the desired tensile strengths can be easily designed through appropriate selection of the amount of reclaimed sand of the present invention to included therein.

EXAMPLE 4

Sand that was mechanically reclaimed according to Example 2 was mixed with 1.8% chemical binder and poured into a core mold to produce a core. The core was then placed inside a green sand mold and run through the casting process. The casting produced met quality standards for dimensions and surface quality.

Although only a few embodiments of the present invention have been described above, it should be appreciated that many modifications can be made without departing from the spirit and scope of the invention. All such modifications are intended to be included within the scope of the present invention, which is to be limited only by the following claims.

We claim:

1. A process for recovering sand, bentonite clay and organic additives from the foundry waste produced by a green sand foundry, the foundry waste being formed from bag house dust and molding waste, the process comprising:

forming an aqueous slurry of the bag house dust, hydraulically separating the slurry in a first hydraulic separation step into an overflow stream comprising at least 60% of bentonite clay originally in the bag house dust and an underflow stream comprising at least 60% of the sand in the bag house dust;

hydraulically separating the overflow stream in a second hydraulic separation step to produce an effluent stream comprising water and less than about 5% sand in the bag house dust; and reusing the sand in the underflow stream and the bentonite clay and organic additives in the effluent stream for making green sand molds.

2. A process for reusing sand, bentonite clay and organic additives used in a green sand foundry in the manufacture of green sand molds and mold cores, the foundry also producing molding waste formed from sand coated with bond, the process comprising:

mechanically removing bond from the sand particles to produce a lighter fraction and a heavier fraction, combining the lighter fraction with water to produce a slurry, hydraulically separating the slurry in a first hydraulic separation step into an aqueous overflow stream comprising at least 60% of the bentonite clay orginally in the lighter fraction and an underflow stream comprising at least 40% of the sand in the lighter fraction, hydraulically separating the aqueous overflow stream in a second hydraulic separation step to produce an effluent stream comprising a maximum of about 5% sand and at least 60% of the bentonite clay orginally in the lighter fraction, reusing the sand in the underflow stream and the bentonite clay in the effluent stream to make green sand molds, and reusing the heavier fraction to make mold cores.

3. The process of claim 2, wherein the heavier fraction contains about 30% to 90% of the sand in the molding waste.

4. The process of claim 2, wherein sand in the heavier fraction has an AFS clay of less than about 0.5.

5. A process for reusing sand, bentonite clay and organic additives used in a green sand foundry in the manufacture of green sand molds and mold cores, the foundry also producing molding waste formed from sand coated with bond and bag house dust containing sand and bentonite clay, the process comprising:

mechanically removing bond from the sand particles of the molding waste to produce a lighter fraction and a heavier fraction, combining the lighter fraction and the bag house dust with water to produce a slurry, hydraulically separating the slurry in a first hydraulic separation step into an aqueous overflow stream comprising at least 60% of the bentonite clay orginally in the slurry and an underflow stream comprising at least 40% of the sand in the slurry, hydraulically separating the aqueous overflow stream in a second hydraulic separation step to produce an effluent stream comprising a maximum of about 5% sand and at least about 60% of the bentonite clay originally contained in the slurry, reusing the sand in the underflow stream and the bentonite clay in the effluent stream to make green sand molds, and reusing the heavier fraction to make mold cores.

6. The process of claim 5, wherein the sand in the underflow steam is a coarse sand product characterized in that at least 80% of the sand in the coarse sand product has a particle size of at least about 60 microns.

7. The process of claim 6, wherein the sand in the overflow steam is a fine sand product characterized in that at least 80% of the sand in the fine sand product has a particle size of less than about 20 microns.

* * * * *